United States Patent [19]

Fleckenstein et al.

[11] 4,411,106

[45] Oct. 25, 1983

[54] MINIATURE BELT GRINDER

[75] Inventors: Elwin H. Fleckenstein, Alden; Walter N. Welsch, Tonawanda, both of N.Y.

[73] Assignee: Dynabrade, Inc., Tonawanda, N.Y.

[21] Appl. No.: 181,969

[22] Filed: Aug. 28, 1980

[51] Int. Cl.[3] ..... B24B 23/06; B24B 55/06

[52] U.S. Cl. ..... 51/170 EB; 51/273

[58] Field of Search ..... 51/170 EB, 170 R, 273, 51/268, 271

[56] References Cited

U.S. PATENT DOCUMENTS

| | | | |
|---|---|---|---|
| 3,785,092 | 1/1974 | Hutchins | 51/273 |
| 3,889,429 | 6/1975 | Zuercher | 51/273 |
| 3,932,963 | 1/1976 | Hutchins | 51/273 |
| 4,209,069 | 6/1980 | Smith | 173/75 |

FOREIGN PATENT DOCUMENTS

| | | | |
|---|---|---|---|
| 2908622 | 9/1979 | Fed. Rep. of Germany | 51/273 |
| 1055527 | 11/1953 | France | 51/170 EB |
| 47-35516 | 11/1972 | Japan | 51/170 EB |
| 128808 | 7/1950 | Sweden | 51/273 |
| 1407628 | 9/1975 | United Kingdom . | |
| 1462156 | 1/1977 | United Kingdom . | |
| 1541768 | 3/1979 | United Kingdom . | |

OTHER PUBLICATIONS

Dynabrade, Inc. Publication No. DBL-2177.

*Primary Examiner*—Roscoe V. Parker

*Attorney, Agent, or Firm*—Bean, Kauffman & Bean

[57] ABSTRACT

A belt grinder having a casing, a drive pulley supported in the casing, a contact pulley mounted on an arm extending from a forward opening in the casing, and endless belt trained about the pulleys, a pneumatic motor housing projecting into the casing, passages in the housing communicating with an annular chamber in the casing, and a fitting secured to the housing having an exhaust passage in communication with the interior thereof, a nozzle member located in the exhaust passage and a slotted passageway communicating with the annular chamber and with the outer periphery of the nozzle member.

8 Claims, 3 Drawing Figures

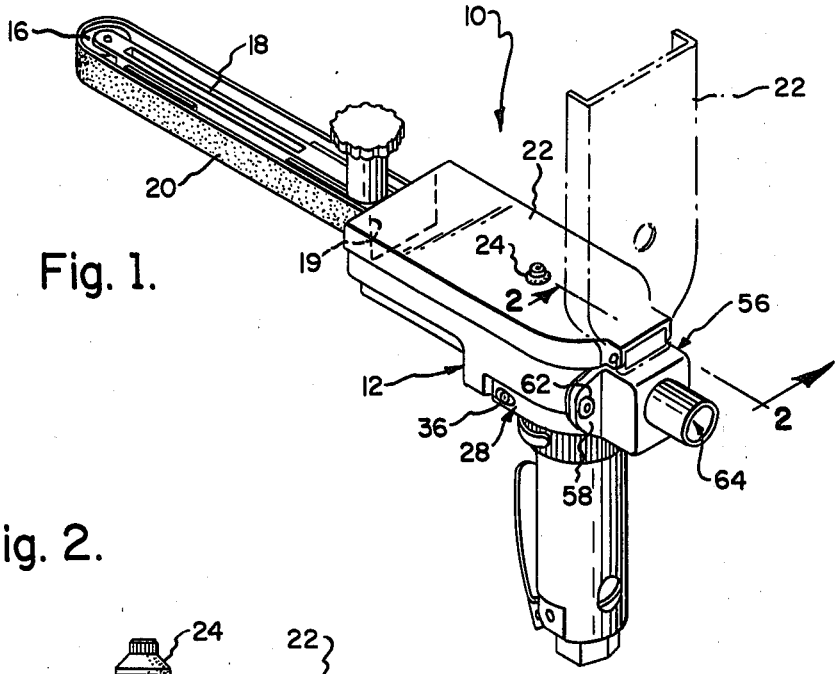
Fig. 1.
Fig. 2.
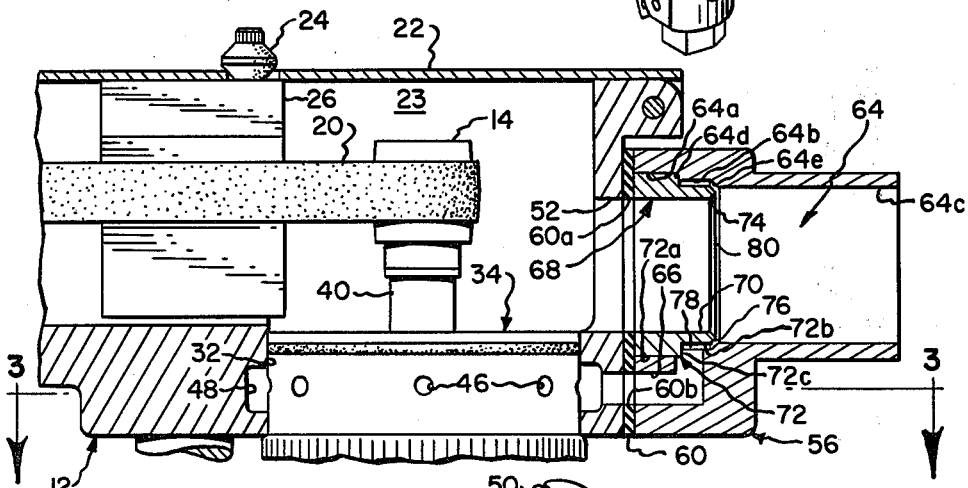
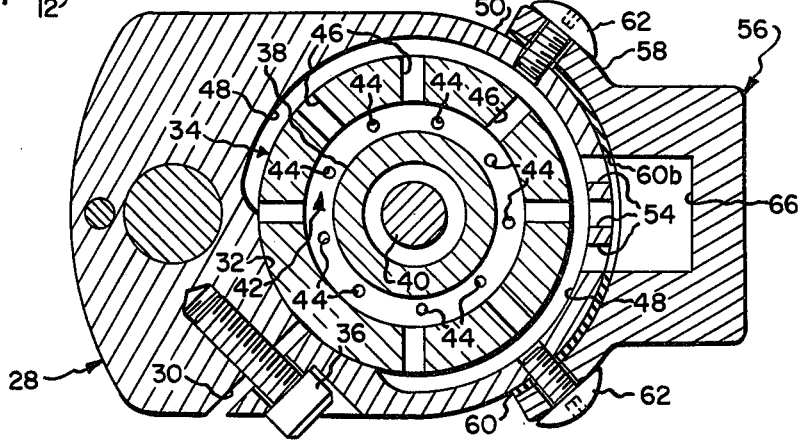
Fig. 3.

MINIATURE BELT GRINDER

SUMMARY OF THE INVENTION

The present invention relates to an improved, manually manipulated, miniature belt grinder for use within small cavities or restricted openings in sheet metal, castings, forgings and the like for deburring and finishing operations, wherein an endless belt having an outer abrasive surface is trained about a drive pulley and a contact wheel or pulley; and, more particularly, to an improved arrangement for providing a "vacuum" pick-up for dust and particles of debris and abrasive grit produced by operation of the grinder and for effecting removal of debris and grit normally tracked or propelled by the belt into the interior of the casing of the grinder, incident to its operation.

More specifically, belt grinders of the type generally referred to above are typically driven by pneumatic motors, which are suitably fixed to the casing of the grinder such that they provide a convenient grinder manipulating handle with the drive shaft thereof extending into the casing and serving to support and effect driven rotating of the drive pulley about which one end of the abrasive belt is trained. Conventional pneumatic motors adapted for use with miniature belt grinders are fitted with an air previous sleeve or bushing disposed concentrically of the drive shaft and inwardly of a plenum chamber receiving at least a portion of the air exhausting from the motor; exhaust air passing radially inwardly through the sleeve for flow axially outwardly along the drive shaft for purposes of cooling and cleaning the drive shaft support bearings. The flow of such exhaust air into and through the grinder casing can create turbulence, which causes dust and particles to be propelled from the casing in random directions, some of which may be in the vicinity of the eyes of an operator.

According to the present invention, the motor housing and the grinder casing are modified in a simple and unique manner whereby at least a portion of the exhausting air is channeled into a venturi-type, restricted passage means causing debris, dust, abrasive grit and other particles to be sucked through the grinder casing and exhausted therefrom in a controlled fashion. In this manner, not only the particles within the casing of the grinder are subjected to suction for removal, but those particles that are generated at the work end of the belt exteriorly of the casing are similarly subjected to suction for removal through the casing as well.

Essentially, the combination according to the present invention provides in a belt grinder having a casing, a drive pulley rotatably supported within the casing about a shaft, a contact pulley spaced from the drive pulley and supported for rotation by an arm assembly projecting through an opening in the casing, an endless belt trained about the pulleys, a pneumatic motor housing surrounding the shaft and partially extending into the casing, the improvement comprising; passage means extending from the motor housing for supplying exhaust gases therefrom to restricted nozzle means supported by the casing and in communication with the interior of the casing for creating a vacuum in the casing whereby grit or debris is sucked from the opening and the casing interior through an exhaust passage in communication with the restricted nozzle means to thereby provide for the efficient and effective removal of dust and grit from the vicinity of the contact pulley, the arm assembly and the interior of the casing.

BRIEF DESCRIPTION OF THE DRAWINGS

For a fuller understanding of the present invention reference should now be made to the following detailed description thereof, taken in conjunction with the accompanying drawings, wherein:

FIG. 1 is a pictorial view of the belt grinder according to the present invention;

FIG. 2 is a fragmentary sectional view taken along line 2—2 of FIG. 1; and FIG. 3 is a sectional view taken along line 3—3 of FIG. 2.

DESCRIPTION OF THE PREFERRED EMBODIMENT

Referring now to the drawings in detail, a tool modified in accordance with the present invention is generally depicted at 10 and is shown as having a casing 12; a drive pulley 14 rotatably supported in the casing; a spaced contact pulley 16 supported by an arm assembly 18 extending through a forward opening 19 in the casing; and an endless, abrasive belt 20 trained about the pulleys. A cover 22 may be suitably pivoted to the casing for closing the interior chamber 23 thereof against latching means 24, supported by a post 26 within the casing.

The bottom surface of casing 12 has a split wall section 28 defining a clamping slot 30 extending from an outer wall thereof to a generally cylindrical mounting opening 32, within which the upper or exhaust end 34 of a pneumatic motor housing is secured by a clamping bolt or the like 36 for drawing opposite sides of slot 30 closer together, as is conventional. Except for the modifications in accordance with the present invention, motor housing 34 is of conventional construction. Suffice to say, then, that the normal pervious sleeve, for exhausting air from the motor, is replaced by a solid impervious sleeve 38 surrounding motor drive shaft 40 and is spaced from the interior wall of the housing to define therewith an annular passage 42. The lower plate upon which the sleeve rests has a plurality of circularly arranged openings or apertures 44, which permit exhaust gas flow to annular passage 42. A plurality of radially spaced passages 46 extending through housing 34 open into a partial annular chamber 48 in casing 12 terminating short of the slotted portion 30.

The casing 12 has a curved outer rear surface 50 containing an upper opening 52 in communication with the interior chamber 23 thereof above motor housing 34 wherein the drive pulley and endless belt are positioned, and containing a plurality of contiguous lower openings 54 which communicate with annular chamber 48.

A vacuum exhaust fitting depicted at 56 has a substantially saddle-shaped end 58 complementary in contour with, and sealingly secured to, curved outer surface 50 by means of a gasket 60 and bolts or the like 62. Gasket 60 is formed with apertures **60*a* and 60*b* disposed for alignment with upper opening 52 and lower openings 54**, respectively.

Fitting 56 is best shown in FIG. 2 as being formed with a stepped diameter through passage or opening 64, which is disposed in axial alignment with upper opening 52 and defined by a front mounting surface **64*a*, an intermediate passageway surface 64*b*, and a rear, outlet or exhaust passageway 64*c*. Intermediate passageway surface 64*b* is joined to front and rear surfaces 64*a*** and 64*c* by a radially extending annular shoulder 64*d* and a rearwardly and inwardly tapering or frusto-conically shaped nozzle surface 64*e*, respectively. Fitting 56 is additionally provided with a flow passageway 66, which has its front end arranged for alignment with lower opening 54 and gasket aperture 60*b* and a rear end arranged to open inwardly through intermediate passageway surface 64*b*.

By again referring to FIG. 2, it will be seen that fitting 56 is provided with a nozzle insert sleeve 68 having a through passageway 70, which is disposed in axial alignment and sized to extend radially coextensive with upper opening 54 and gasket aperture 60*a*; and a stepped diameter external surface 72, which is defined by an enlarged front mounting surface 72*a* joined to a rear passageway surface 72*b* by a radially extending annular shoulder 72*c*. A rear end or annular rim of insert sleeve 68 is wedge shaped in section and defined by a rearwardly and outwardly tapering extension 74 of through passageway 70 and a rearwardly and inwardly tapering extension 76 of rear passageway surface 72*b*. As will be apparent, insert sleeve 68 is positionally located within stepped diameter passage 64 by engagement of shoulder 64*d* and 72*c*, and by engagement of mounting surfaces 64*a* and 72*a*. When sleeve insert 68 is so positioned, passageway surfaces 64*b* and 72*b* are radially spaced apart to define an annular chamber 78 communicating with flow passageway 66; and tapered surfaces 64*e* and 76 are radially separated to define an outer annular, restricted nozzle exhaust opening or passage means 80 placing annular chamber 78 in flow communication with rear passageway portion 64*c*.

It should be readily apparent from the foregoing description that, in operation, opening 46, annular chamber 48, slotted openings 54 and slotted passageway 66 function as combined passage means for supplying exhaust gases from motor housing passage 42 through the restricted nozzle restricted exhaust opening 80 to exhaust passage 64*c*. The flow of gases through nozzle opening 80 creates a vacuum or low pressure condition in passage 70 downstream thereof, as compared with the higher ambient pressure existing in the chamber 23 of the casing 12, to thereby induce a flow of air through forward opening 19, through chamber 23, through opening 52, passage 70 and to exhaust passage 64*c* for disposal of dust and/or grit in the vicinity of belt 20 from the contact pulley forward end thereof, from along the arm assembly 18 and from chamber 23, in a controlled manner.

Although a preferred embodiment of the present invention has been disclosed and described, changes will obviously occur to those skilled in the art. It is, therefore, intended that the present invention is to be limited only by the scope of the appended claims.

What is claimed is:

1. In a belt grinder having a casing, a drive pulley rotatably supported within the interior of said casing by a drive shaft of a pneumatic motor, a contact pulley spaced from said drive pulley and supported for rotation by an arm assembly projecting through a forward opening of said casing, and an endless belt trained about said pulleys, said motor having a housing secured to said casing and surrounding said shaft, the improvement, comprising:

passage means for venting exhaust air from said motor housing;

an exhaust passage in communication with said interior of said casing; and restricted exhaust passage means in communication with said passage means and said exhaust passage for generating therethrough high velocity flow of exhaust air from said motor housing to said exhaust passage to induce a flow of ambient air through said casing opening and said interior of the casing through said exhaust passage for the removal of dust, grit or debris therefrom, said restricted exhaust passage means comprises an annular nozzle adjacent said exhaust passage, and said passage means includes an annular chamber in surrounding relation to said annular nozzle.

2. The improvement according to claim 1, wherein:

said passage means further includes a second annular chamber located in said casing in surrounding relation to said motor housing and a plurality of radial openings in said motor housing for providing communication between the interior thereof and said second annular chamber.

3. In a belt grinder having a casing, a drive pulley rotatably supported within the interior of said casing by a drive shaft of a pneumatic motor, a contact pulley spaced from said drive pulley and supported for rotation by an arm assembly projecting through a forward opening of said casing, an endless belt trained about said pulleys, said motor having a housing secured to said casing and surrounding said shaft, the improvement, comprising:

passage means for venting exhaust air from said motor housing;

an exhaust passage in communication with said interior of the casing; and restricted exhaust passage means in communication with said passage means and said exhaust passage for generating therethrough high velocity flow of exhaust air from said motor housing to said exhaust passage to induce a flow of ambient air through said casing opening and said interior of said casing through said exhaust passage for the removal of dust, grit or debris therefrom, said motor housing having a substantially cylindrical upper end projecting into said casing and said passage means includes a plurality of radially extending passages opening through said upper end of said motor housing.

4. The improvement according to claim 3, wherein:

said restricted exhaust passage means includes a nozzle member having a wedge-shaped end adjacent said exhaust passage and defining therewith an annular nozzle exhaust opening;

said nozzle member having a central inner passage in communication with said interior of said casing; and said passage means is in communication with said nozzle exhaust opening.

5. The improvement according to claim 4, wherein:

said passage means further comprises a substantially annular chamber in said casing in surrounding relation to said upper end of said motor and in communication with said radially extending passages and said nozzle exhaust opening.

6. An endless belt grinder comprising in combination:

a casing having an interior, a lower surface, a rear surface, a forward opening communicating with said interior, a mounting opening communicating with said interior through said lower surface and an upper opening communicating with said interior through said rear surface;

a pneumatic motor having a housing surrounding a drive shaft projecting from one end of said housing, said one end of said housing is fixed within said mounting opening with said drive shaft received within said interior of said casing;

drive and contact pulleys for supporting an endless abrasive belt when trained thereabout, said drive pulley is mounted within said interior of said casing by said drive shaft and said contact pulley is supported exteriorly of said casing by an arm assembly projecting through said forward opening;

passage means for venting exhaust air from said motor, said passage means including a plurality of radially opening passages formed in said one end of said housing for permitting a flow of exhaust air from said motor, a chamber adjacent said mounting opening for receiving said exhaust air from said radially opening passages and a passageway extending from said chamber;

an exhaust passage means communicating with said interior of said casing through said upper opening; and a nozzle exhaust opening communicating with said exhaust passage means and said passageway for generating through said exhaust passage means a high velocity flow of exhaust air to induce a flow of ambient air through said forward opening and said interior of said casing and then through said exhaust passage means.

7. A grinder according to claim 6, wherein said nozzle exhaust opening extends annularly of said exhaust passage means.

8. A grinder according to claim 6, wherein said rear surface of said casing includes a lower opening; and a vacuum exhaust fitting is fixed to said rear surface, said fitting having a through passage aligned with said upper opening, a flow passageway having a front end aligned with said lower opening and a rear end, and a nozzle insert sleeve disposed within a front end of said through passage and cooperating therewith to define an annular chamber communicating with said rear end of said flow passageway and an annular nozzle exhaust opening communicating with said through passage intermediate said front end and a rear end of said through passage, said sleeve insert having a through passageway cooperating with said rear end of said through passage to define said exhaust passage means, and the first said passageway including said lower opening, said flow passageway and said annular chamber.

* * * * *